United States Patent [19]

Murata

[11] 4,089,541

[45] May 16, 1978

[54] SKI BOOT HEEL BINDING HAVING IMPROVED UNLOCKING DEVICE

[75] Inventor: Masahiro Murata, Matsudo, Japan

[73] Assignee: Hope Co. Ltd., Japan

[21] Appl. No.: 763,417

[22] Filed: Jan. 28, 1977

[30] Foreign Application Priority Data

Oct. 26, 1976 Japan ..... 51-143111

[51] Int. Cl.[2] ..... A63C 9/08

[52] U.S. Cl. ..... 280/631

[58] Field of Search ..... 280/631, 632, 626, 628

[56] References Cited

U.S. PATENT DOCUMENTS

| | | | |
|---|---|---|---|
| 3,733,082 | 5/1973 | Murata et al. | 280/632 |
| 3,773,341 | 11/1973 | Mimeur | 280/632 |
| 3,836,163 | 9/1974 | Hashioka | 280/632 |

*Primary Examiner*—Robert R. Song

*Attorney, Agent, or Firm*—Emrich, Root, O'Keeffe & Lee

[57] ABSTRACT

A ski boot heel binding having a cam member slidably disposed within a bore formed in the lengthwise direction of a main body is disclosed, wherein the cam member is connected to the front end of a rotatably mounted unlocking lever. The unlocking lever has an inclined shoulder at the upper portion thereof against which a fulcrum pin bears and which is fixed relative to the main body, whereby when the rear end of the unlocking lever is lifted, the fulcrum pin slides down relative to the shoulder with the result that the fulcrum point of the leverage is shifted so as to retract the cam member in a straight line along the bore and displace the binding to the heel releasing position.

5 Claims, 5 Drawing Figures

SKI BOOT HEEL BINDING HAVING IMPROVED UNLOCKING DEVICE

BACKGROUND OF THE INVENTION

This invention relates to a ski boot heel binding having an improved unlocking device which can be manually operated to displace the binding to a heel releasing position by lifting the rear end of an unlocking lever.

A ski boot heel binding in which a locking cam member is disposed under spring force within a bore formed in the lengthwise direction of a main body is very simple in structure and accurate in operation, since the cam member can slide along the axis of the bore and the spring. However, a known unlocking device of the type set forth above is complicated in structure and not suited for use with the binding of the type set forth above. That is, in the event that the locking lever is pivotally connected at the intermediate portion thereof and secured to the cam member at the inner front end portion thereof, when the rear end of the lever is lifted up, the cam member receives such a force as to rotate about the intermediate pivot portion of the lever and cannot be retracted along the axis of the bore.

BRIEF SUMMARY OF THE INVENTION

Accordingly, a main object of the present invention is to provide an unlocking device which can be adapted to the ski boot heel binding set forth above.

Another object of the present invention is to provide an unlocking device of a ski boot heel binding which is simple in structure and reliable in operation.

Still another object of the present invention is to provide an unlocking device of a ski boot heel binding which can displace the binding to a heel releasing position by a small force applied upwardly to the rear end of an unlocking lever.

A further object of the present invention is to provide an unlocking device of a ski boot heel binding in which an unlocking lever can automatically return to the upper surface of the binding when an upward force applied to the rear end of the lever is removed therefrom.

The present invention is adapted to a ski boot heel binding which comprises a main body having a bore formed in the lengthwise direction thereof, a cam member slidably disposed within the bore, and yieldable means for urging the cam member forwardly against a cross bar. According to the present invention, an unlocking lever is connected at the front end portion thereof to the cam member and has an inclined shoulder at the upper portion thereof against which a fulcrum pin bears which pin is fixed relative to the ski contacts. Therefore, when the rear end of the unlocking lever is lifted, the fulcrum pin slides down relative to the shoulder with the result that the fulcrum point of the leverage is shifted to retract the cam member in a straight line along the bore and release the engagement of the cam member with the cross bar.

Preferably, the main body has horizontal slots formed through both side walls thereof which are parallel with the bore. The cam member has a transverse rod connected thereto and extending through the horizontal slots. The unlocking lever has bifurcated arms connected at the front end portion thereof to both ends of the transverse rod. Each bifurcated arm has an inclined shoulder thereon.

The main body is also preferably provided between a pair of supporting side frames mounted on a base plate and pivotally connected thereto by a transverse shaft extending through the rear portion thereof. The main body also has a substantially vertical slot through which the cross bar extends and which is secured at both ends thereof to the front portion of the side frames. The fulcrum pin is secured to a side frame above and rearwardly of the cross bar.

A spring having a relatively low spring force may be provided to act against the inner end of the arm of the unlocking lever to urge the rear end of the lever toward the upper surface of the main body.

Also, the fulcrum pin may be provided with a roller ring thereabout to reduce the frictional resistance between it and the inclined shoulder of the lever.

Other objects and features of the present invention will become apparent from the following detailed description of a preferred embodiment thereof, when taken in conjunction with the accompanying drawings.

DETAILED DESCRIPTION OF THE INVENTION

Figure 1:
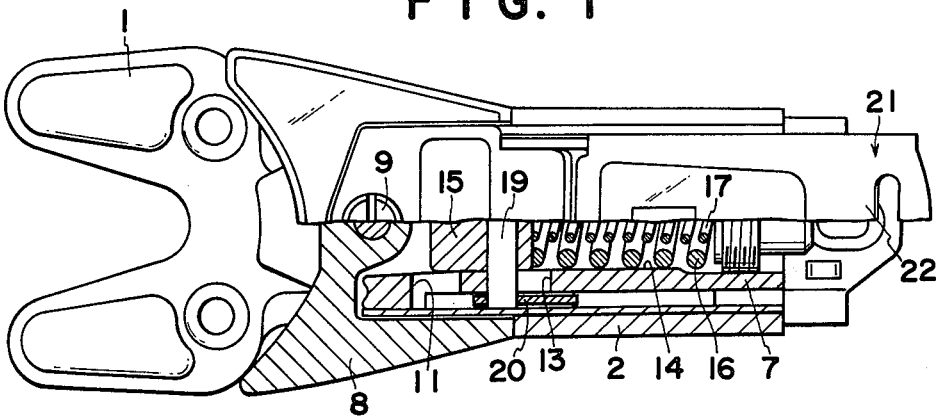
FIG. 1 is a plan view partly in section showing a ski boot heel binding employing an unlocking device according to an embodiment of the present invention.

Referring to a preferred embodiment of the present invention shown in the drawings, a ski boot heel binding comprises a base plate 1 adapted to be mounted on a ski. A pair of vertical side frames 2—2 are provided, one at each side of the base plate 1 and mounted for sliding movement in the lengthwise direction thereof. The sliding movement of the side frames 2—2 is effected by an adjusting screw 3 extending through a vertical wall on the base plate 1 and acting against the rear end of a compression spring 4, the front end of which is received by a block 5 supported by a transverse pin 6 at the front lower end of the side frames 2—2. The compression spring 4 is used to provide a yieldable forward compressive force to the boot heel when the ski boot is set on the ski between this binding and a cooperative toe binding (not shown).

Figure 4:
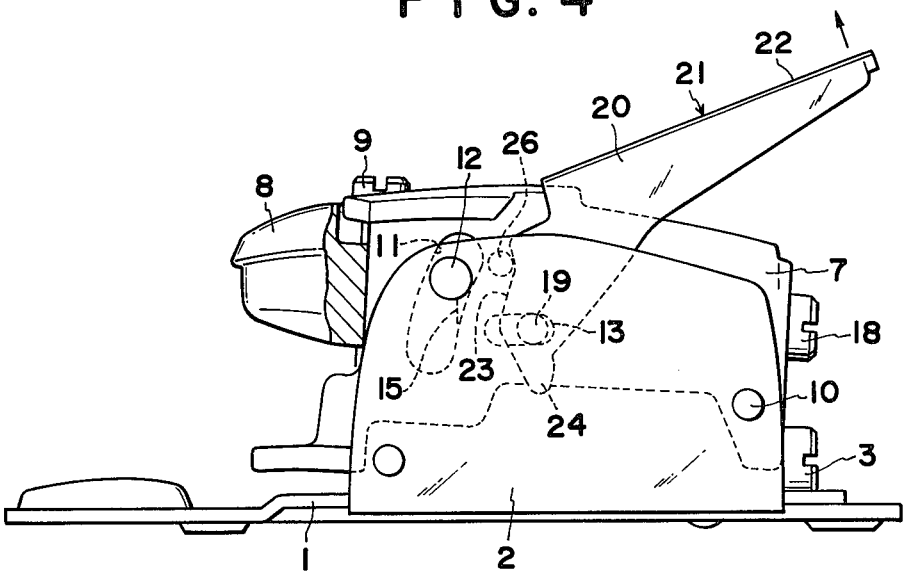
FIG. 4 is a side elevational view showing the same heel binding but illustrating the unlocking lever partially displaced toward the heel releasing position thereof.
Figure 5:
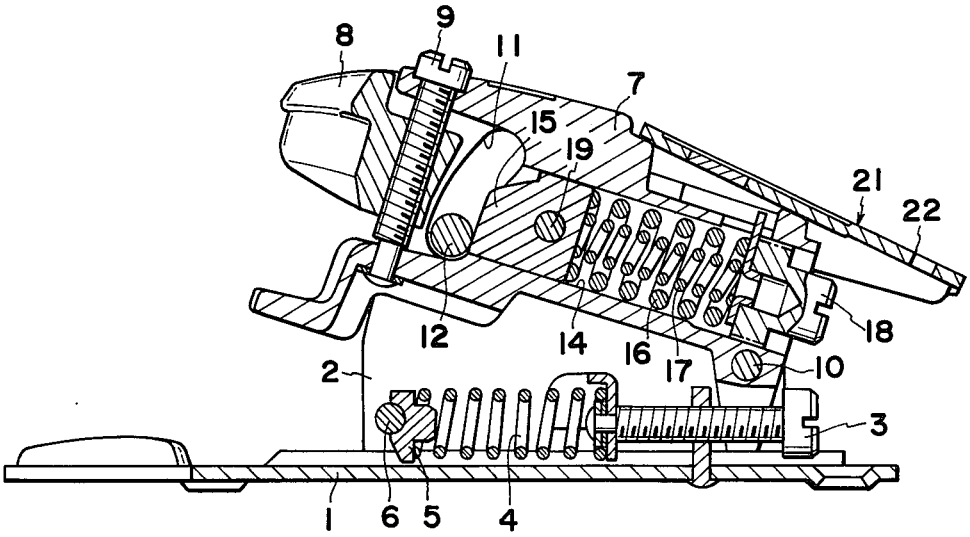
FIG. 5 is a longitudinal vertical sectional view showing the same heel binding displaced to the heel releasing position thereof.

Disposed between the side frames 2—2 is a pivotable main body 7 which has a heel holding jaw or piece 8 at the front end thereof. The heel holding piece 8 can be adjusted to a desired height by a threaded rod 9 so as to firmly hold boot heels of different heights or thicknesses in the heel holding position. The main body 7 is swingably pivoted to the rear end of the side frames 2—2 by a transversely extending rod 10, so that it can rotate or swing upwardly about the rod 10 from the heel holding position of FIGS. 1-4 to a heel releasing position as shown in FIG. 5. The main body 7 has a vertically extending arcuate elongated slot 11 formed therein adjacent the front end portion thereof with the rod 10 as the center of curvature thereof. Extending transversely through the vertical slot 11 is a cross bar 12 secured to the upper front end of the opposed side frames 2—2 at the both ends thereof. The main body 7 also has a horizontally extending elongated slot 13 therethrough rearwardly of and adjacent to the vertical slot 11.

The pivotable main body 7 has a horizontal bore 14 therethrough in the lengthwise direction thereof, in which a cam member 15 is slidably disposed. A pair of large and small compression springs 16 and 17, respectively, are also provided in the bore 14 to urge the cam member 15 forwardly against the cross bar 12, the degree of compression of which may be adjusted by an adjusting screw 18 extending outwardly beyond the main body at the rear end thereof. Extending through the cam member 15 is a rod 19, which also extends through the horizontal slots 13 in the main body 7, and terminates at each end thereof adjacent the inner surfaces of the side frames 2—2.

The rod extending through the cam member 15 is connected at the both ends thereof to the forward ends of the spaced arms 20—20 of an unlocking lever 21. The unlocking lever 21 has an outwardly projecting rear end 22 from which the arms 20—20 are bifurcated in the vertical direction and each extends into a space between the inner surface of a side frame 2 and the adjacent outer surface of the main body 7. Each arm 20 of the unlocking lever 21 has an inclined end surface or shoulder 23 at the forward end thereof above the rod 19, which merges with a downwardly extending inner end 24. A small compression spring 25 is provided between the inner end 24 of each arm 20 of the lever 21 and the rear portion of the main body 7 to urge the rear end 22 of the lever 21 downwardly toward the rear end surface of the main body 7.

A pin 26 secured to the upper portion of each side frame 2 is located rearwardly of the cross bar 12 and is in contact with the adjacent shoulder 23 of a lever 21. Each pin 26 extends toward the main body 7 but terminates short thereof to allow the latter to swing up relative to the side frames 2—2.

If desired the pin 26 may be provided with a roller ring thereabout.

Figure 2:
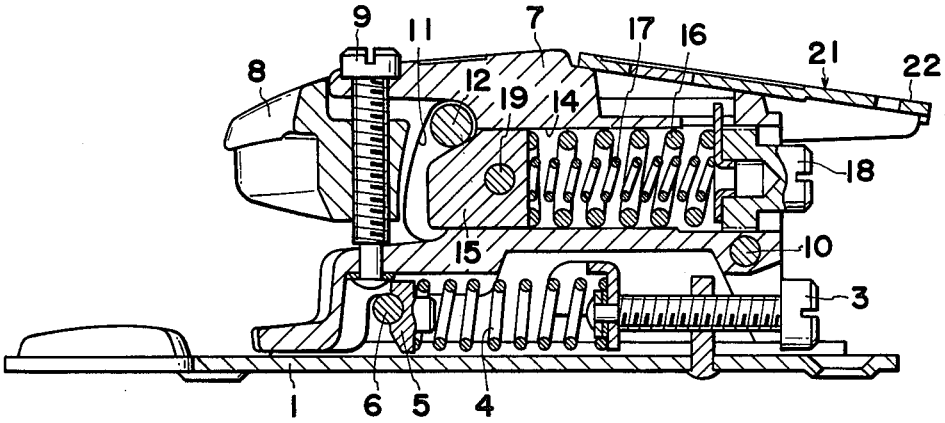
FIG. 2 is a longitudinal vertical sectional view through the device of FIG. 1 showing the same heel binding.
Figure 3:
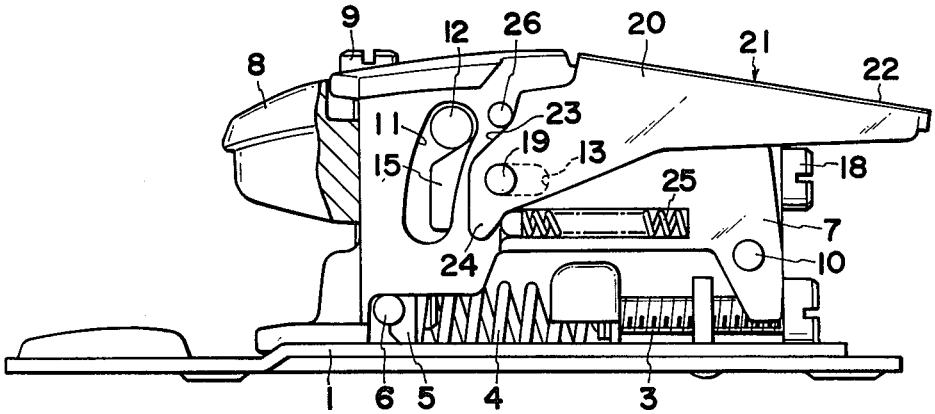
FIG. 3 is a side elevational view of the device of FIG. 2 with a side frame thereof removed.

In the present heel binding at the heel holding position shown in FIGS. 1 to 3, the cam member 15, which is disposed within the horizontal bore 14 of the main body, is pressed against the lower section of the secured cross bar 12 by the compression forces of the springs 16 and 17, whereby the main body 7 is prevented from swinging up about the rod 10. When a severe upward thrust or shock is applied to the heel holding piece 8 by a skier's boot, the heel holding piece receives such a force as to cause the main body 7 to rotate about the rod 10 and, thereby, the cam member 15 is retracted along the bore 14 by the cross bar 12 against the compression forces of the springs 16 and 17, which allows the main body 7 to rotate or swing up about the rod 10 toward a heel releasing position.

In order to manually displace the present heel binding from the heel holding position to the heel releasing position shown in FIG. 5, it is necessary to lift the rear end 22 of the unlocking lever 21. That is, when an upward force is applied to the rear end 22 of the lever 21, the inclined surface or shoulder 23 of the lever 21 will be pressed against the pin 26 and, due to the leverage, the applied upward lifting force acts to retract the rod 19 along the horizontal slot 13 as the contact point of the shoulder 23 with the pin 26 functions as a fulcrum point. Thus, as the rear end of the lever 21 is moved upwardly, as shown in FIG. 4, the pin 26 slides relative to the inclined shoulder 23 and, therefore, the fulcrum point of the leverage is moved down, so that the rod 19 and the cam member 15 connected thereto are smoothly retracted along the horizontal slot 13 and the bore 14, respectively. At the time when the front end of the cam member 15 is retracted enough beyond the rear end section of the cross bar 12, the main body 7 will be displaced to the heel releasing position shown in FIG. 5. In the heel releasing position, when the force which had been applied to the rear end 22 of the lever 21 is removed, the lever 20 will rotate in a clockwise direction from such a position as shown in FIG. 4, and will return to the upper surface of the main body 7 as shown in FIG. 5 by the action of the spring 25.

As may be understood from the disclosure set forth above, the unlocking device of the present invention is simple in structure and reliable in operation since it employs a leverage in which the point of force is at the rear end 22 of the lever 21, the fulcrum point is at the contact point of the pin 26 with the inclined shoulder 23 of the lever, and the point of action is at the connecting portion of the lever 21 with the connecting rod 19. Also, the pin 26 slides relative to the inclined shoulder 23 of the lever 21 to shift the fulcrum point gradually as the rear end of the lever is lifted up, so that the cam member 15 and the rod 19 connected thereto are smoothly retracted in a straight line along the bore 14 and the horizontal slots 13, respectively.

In the preferred embodiment of the present invention shown in the drawings, when the rear end of the lever is partially lifted, the direction of force applied to the pin 26 by the inclined shoulder 23 of the lever 21 passes below the cross bar 12, so that the displacement of the heel binding to the heel releasing position can be made with a relatively small force. Also, when the front end of th cam member 15 is retracted beyond the rear lower section of the cross bar 12, the cam member is then pressed against the rear upper section of the cross bar 12 by the action of the springs 16 and 17, so that the pivotable main body 7 is automatically displaced to the heel releasing position.

The present structure is such that the spring 25, of relative low spring force, acts against the inner end of the arm 20 of the lever 21 to urge the rear end 22 thereof downwardly toward the upper surface of the main body 7, and when the upward force applied to the rear end of the lever 21 is removed, the lever will return to the upper surface of the main body, thereby eliminating any danger which may be caused in the event the rear end of the lever projects upwardly above the main body.

In addition, when the fulcrum pin 26 is provided with a roller ring thereabout, the frictional resistance between the pin and the inclined shoulder 23 of the lever 21 is reduced, so that the unlocking operation is further facilitated.

Although the present invention has been described with reference to the preferred embodiment thereof, many modifications and alterations may be made within the spirit of the present invention, provided they fall within the scope of the claims appended hereto.

I claim:

1. A ski boot heel binding comprising support means, a main body having boot heel engaging means at the forward end thereof and a bore formed therethrough in the lengthwise direction thereof, means pivotally mounting said main body on said support means, a cam member slidably disposed within said bore, a cross bar located forwardly of said cam member and fixedly mounted on said support means, yieldable means for urging said cam member forwardly against said cross bar, an unlocking lever pivotally connected at the front end portion thereof to said cam member and having an inclined shoulder at the upper portion thereof, a fulcrum pin fixed to said support means and in contact with said inclined shoulder of said lever, whereby when the rear end of said unlocking lever is lifted, relative movement between said pin and said shoulder results in a shifting of the fulcrum point of the leverage causing said cam member to retract along said bore and release the engagement of said cam member with said cross bar.

2. A ski boot heel binding as claimed in claim 1, wherein said support means includes a side frame on each side of said main body, a horizontal slot formed in each said side frame parallel with said bore, said cam member has a transverse rod connected thereto and extending through said horizontal slots, and said unlocking lever has bifurcated arms connected at the front end portion thereof to both ends of said transverse rod, said inclined shoulder being formed on each bifurcated arm at the front end portion thereof.

3. A ski boot heel binding as claimed in claim 2, wherein said main body and the side frames are mounted on a base plate, a transverse rod extending through the rear portion of said main body and said side frames thereby pivotally mounting said main body on said side frames, said main body also having a substantially vertical slot through which said cross bar extends and which is secured at both ends thereof to the front portion of said side frames, said fulcrum pin being secured to said side frames rearwardly of the upper rear portion of said cross bar.

4. A ski boot heel binding as claimed in claim 2, further comprising a spring of relatively low spring force acting against the inner end of the arm of said lever to urge the rear end of said lever toward the upper surface of said main body.

5. A ski boot heel binding as claimed in claim 1, wherein said fulcrum pin is provided with a roller ring thereabout.

* * * * *